United States Patent [19]

Loy

[11] 4,243,191

[45] Jan. 6, 1981

[54] HOODED KITE

[76] Inventor: John W. Loy, P.O. Box 1281, Bartlesville, Okla. 74003

[21] Appl. No.: 43,109

[22] Filed: May 29, 1979

[51] Int. Cl.[3] ..... B64C 31/06

[52] U.S. Cl. ..... 244/153 R

[58] Field of Search ..... 244/153 R, 154, 155 A; D21/88, 89

[56] References Cited

U.S. PATENT DOCUMENTS

| | | | |
|---|---|---|---|
| 2,737,360 | 3/1956 | Allison | 244/153 R |
| 3,309,045 | 3/1967 | Kinney | 244/153 R |
| 3,480,238 | 11/1969 | Barish | 244/153 R |
| 4,081,158 | 3/1978 | Pearce | 244/153 R |

*Primary Examiner*—Charles E. Frankfort

*Attorney, Agent, or Firm*—James H. Chafin

[57] ABSTRACT

A hooded kite, which is an improvement over the conventional sled type kite, comprises a central panel, or canopy, of light-weight sheet material, generally in a rectangular shape. It has two long sides. A hood is provided which is generally made of the same material as the canopy, and is in a trapezoidal shape. The long edge is equal in length to, and is attached to the leading edge of the canopy. The shorter edge is less in length than the width of the central canopy at a distance back from the leading edge, corresponding to the width of the hood. The two short ends are tapered and are attached to the longitudinal edges of the canopy. The shorter base is not attached to the canopy, so that in flight there is a wedge of air space between the hood and the canopy.

9 Claims, 4 Drawing Figures

30A
34A'
19
34B'
18
36
10
70
14
30
2
18
22B
34B
19
76
80
22A
34A
78
26A
36
72
14
128B
28A
26B
38A
38B
24B
24A
38A 2
32
40
74

12
16
20
66
50
57A
54A'
54B'
57B
64'
64
61
60A
54A
54B
60B
16
56A
56B
58A
58B
68

62
52

HOODED KITE

CROSS-REFERENCE TO RELATED APPLICATION

This application is related to my co-pending application Ser. No. 043,108, filed on the 29th day of May, 1979, and entitled "SWALLOWTAIL KITE".

BACKGROUND OF THE INVENTION

1. Field of the Invention

This invention lies in the field of kites. More particularly it concerns improvements in kites of the type universally known as sleds.

The particular improvement comprises a hooded sled type kite, which is less susceptible to collapse of the kite in adverse winds, while maintaining the well known features of flexible kites and without impairing flight performance otherwise.

2. Description of the Prior Art

The prior art is described in many books on the subject of kites, such as, for example Brummitt, "Kites", Golden Press, New York, N.Y. 1971.

In the prior art there have been examples of sled type kites which are principally rectangular sheets of thin material stiffened by two parallel strips or battens one on each of the longitudinal edge of the sheet of the central panel. There are two triangular side panels or laterals with bases equal in length to the long sides of the central panel and attached thereto. Cords are attached to each of the points of the side panels and these are joined together to form a bridle. The bridle is attached to a flight line in a conventional manner.

These kites have been shown to be sensitive to collapse in turbulent wind. They also tend to fly at a high angle of attack, providing small lift-to-drag ratio, and thus fly at low elevation.

SUMMARY OF THE INVENTION

A principal object of this invention is to minimize, in a simple way, collapse of soft leading edge kites without departing from the desirable features of flexible kites, and without impairing flight performance otherwise.

Another object of this invention is to improve flight performance by enabling kites of soft leading edge to fly at smaller angles of attack and therefore with higher lift/drag ratio.

A sled type kite is one which is stiffened in the longitudinal dimension by at least two battens, with no transverse stiffening. The leading and trailing edges are therefore called "soft", since they are only supported in flight by the pressure of the wind on the under surface, and in the absence of windflow they collapse into a folded position.

A common source of failure of kites with soft leading edges, is an uneven wind condition, containing an updraft component. Environments favorable to kite flying also frequently generate updrafts, either because of the terrain or because of thermal effects.

When a kite faces a wind having an updraft component, the kite automatically adopts an attitude (angle of attack) based on the vectorial direction of the wind at the moment. For example, in a wind of level component of 4.0 knots and upward component of 2.0 knots, the vectorial velocity is 4.5 knots, but what is more important, the vectorial direction of the wind is 26.6° above a horizontal datum. If the kite is bridled to fly at 30° attitude, which is close to the minimum for the class concerned, its attitude to the observer will appear to be about 3.4° to the horizontal, and the kite may well be nearly overhead in elevation.

Unfortunately, updrafts seldom are constant. In the case first cited, if the updraft ceases, even for a few moments, the kite will suddenly be facing the wind at an intolerable attitude of, say, 3.4°. The soft leading edge and the kite itself will usually collapse. This is because semi-rigid or non-rigid kites depend on wind pressure to maintain the surfaces in tension. This tension enables the kite to sustain a more or less isomorphic form suitable for reliable flight. When wind pressure fails, the tension fails, and the kite fails.

In wind of given velocity, the pressure on the kite is a direct function of the sine of the angle of attack. For instance, the sine of 30° is 0.50, whereas the sine of 15° is about 0.26. At an attitude less than about 30°, therefore, the wind pressure usually is not sufficient to sustain the necessary configuration in flight for a soft, or semi-rigid kite, even though the lift would otherwise be adequate.

I have discovered that this deficiency in kites of soft leading edges can be simply overcome by installing an additional surface of relatively small area, which I call a hood, at, and adjacent to, the leading edge, and having an angle of attack greater than that of the canopy. The hood is on the windward side of the canopy. The leading edge of the hood is suitably joined to the leading edge of the canopy. The lateral edges of the hood are suitably joined to the edges of the canopy. The trailing edge of the hood is not joined to the canopy. This trailing edge is shortened by an increment of approximately 7 to 10 percent of the lateral, flat dimension at the leading edge. This shortening tapers to zero at the leading edge.

Soft or semi-rigid kites, such as the sled, are concave toward the wind around a longitudinal axis. The shortening of the hood causes its trailing edge to conform to an arc of greater radius than that of the canopy. Thus, is flight, there is an air space between the hood and the canopy.

As in my copending application Ser. No. 043,108 there are two sides, or lateral panels attached to the longitudinal edges of the canopy. A bridle has two cords which are tied, one to each of the peaks of the triangular laterals. The shape of the canopy can be rectangular, or can taper in width from the leading to trailing edge. If desired a halter can be tied between the trailing edges of two battens fastened to the edges of the canopy.

BRIEF DESCRIPTION OF THE DRAWINGS

These and other objects and advantages of this invention, and a better understanding of the principles and details of the invention, will be evident of the following description, taken in conjunction with the appended drawings, in which.

DESCRIPTION OF THE PREFERRED EMBODIMENT

Figures 1, 2, 3, 4:
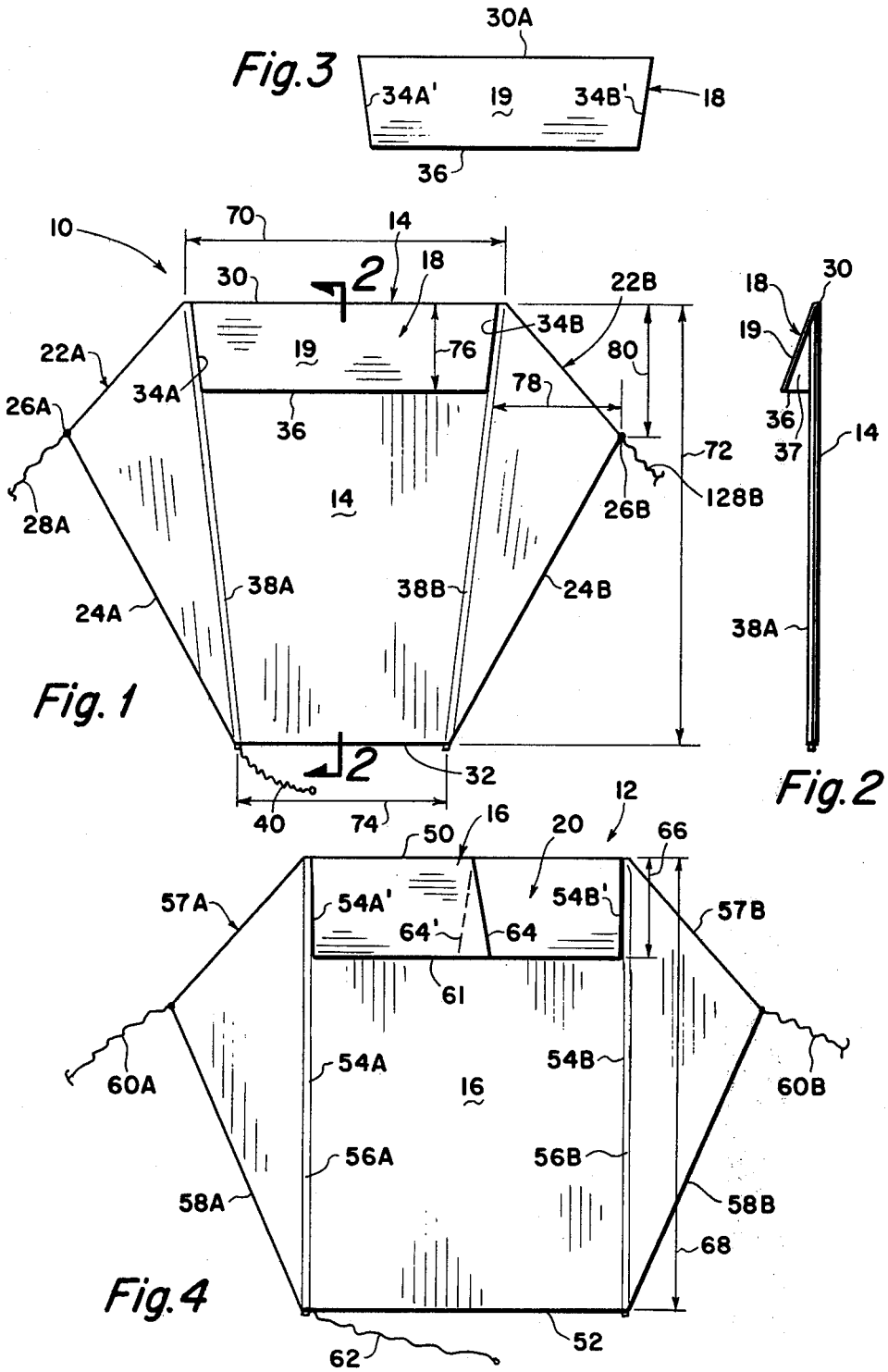
FIG. 1 illustrates one embodiment of this invention.
FIG. 2 illustrates a view taken across the plane 2—2 of FIG. 1.
FIG. 3 illustrates a flap or hood which is attached to the leading edge of the central panel of FIG. 1.
FIG. 4 illustrates another embodiment of this invention.

Referring to the drawings, and in particular to FIG. 1, there is shown one embodiment of this invention indicated generally by the numeral 10. It comprises a central panel or canopy 14, which is roughly of rectangular shape, as shown in FIG. 4, but may be in a trapezoidal shape, as shown in FIG. 1, in which the leading edge 30 is slightly longer than the trailing edge 32. The central panel 14 has two side edges 34A and 34B, which are stiffened by means of two battens 38A and 38B. The leading edge 30 has a width 70, which is greater than the width 74 of the trailing edge 32. The width 74 of the trailing edges 32 may be in the range of ratio of 0.6 to 0.8 of the length 70 of the leading edge 30.

There are two side panels or laterals, indicated generally by the numerals 22A and 22B, which are triangular in shape with the base equal in length to, and attached one to each of the edges 34A and 34B. At the peaks 26A and 26B of the side panels, cords 28A and 28B, or tethers, are tied. These can be tied together at a junction with a flight line, to form a bridle, which facilitates holding the kite in the shape of a trough, so as better to catch the wind, and provide a lift, to get the kite up into the sky.

The front, or leading edge, of the panel 14, can be extended a select distance beyond the ends of the batten and this panel then folded back about the line 30, which will become the new leading edge, to form a flap or hood 19, which is attached at its ends to the edges 34A and 34B of the panel 14. This hood or flap 19 is a trapezoidal shaped piece of sheet material, which may be similar to, or identical to, the material of which the center and side panels are made. It is attached on three sides 30A, 34A' and 34B' to the sheet 14 of the central panel. The edge 36 is unattached and is shorter in length than the spacing between the edges 34A, 34B. Thus as shown in FIG. 2, which is a cross-sectional view, along the plane 2—2 of FIG. 1, the flap or hood will pull away from the plane of the panel 14, leaving an airspace therebetween.

Referring now to FIG. 4, there is shown a second embodiment of this invention, which is similar to FIG. 1, except that it shows a truly rectangular shape of the central panel or canopy 16. Again, two stiffening battens 56A and 56B are provided, attached to the material of the central canopy 16 along the two edges 54A and 54B. Similar to FIG. 1, the side panels 57A and 57B are attached along the edges 54A and 54B of the central canopy 16, and again tether cords 60A and 60B are provided to form a bridle.

Also shown in FIG. 4 is the tension cord or halter 62, which is attached between the trailing ends of the two battens 56A and 56B. The halter 62 is shorter than the width of the trailing edge 52, and serves to form the central canopy into a curved sheet in order to better catch the wind, when the wind velocity is low. The halter 40, as shown in FIG. 1 may be used on the kite 10.

In FIG. 4 the flap or hood, indicated generally by the numeral 20, is attached to the leading edge 50 of the central panel 16, and is attached also at its edges 54A' and 54B' to the edges 54A and 54B of the central canopy 16. In other words the hood 20 starts out as a rectangular flap and is attached at the leading edge 50 and at the two ends to the panel 16 leaving the trailing edge 61 of the flap free, similar to that of the edge 36 of the hood 19 in FIGS. 1 and 2.

The hood 20 is then cut along the line 64, and the edge 64 is pulled to the left into the position of the dashed line 64' and the two edges are joined together by any selected means, such as the use of adhesive. This forces the shape of the flap into the trapezoidal shape, more or less like 19 of FIG. 3, although it does also change the edge 50 into a broken line with a small angle. Shortening the edge 61 by the method just mentioned, tends to pull the battens 56A and 56B closer together along the trailing edge 61 so that the plane view of the kite would look somewhat like that of FIG. 1, except that there is a truly rectangular sheet of material 16 which provides more space between the hood and the canopy.

The width 66 of the hood 20 can be of the order of 0.2 of the length 68 of the kite 12.

When the hooded kite 10 or 12 is flying the canopy is formed into a generally concave semi-cylinder of a certain radius of curvature. Since the hood, at its trailing edge is shorter than the width of the canopy, it will form into a somewhat conical shape, of greater radius of curvature than the canopy, extending away from the canopy surface.

This does two things to lessen the tendency of the kite to collapse.

1. The hood with air between it and the canopy resists collapsing because the combination cannot fold unless all the air is driven from the space 37 (FIG. 2). Since this takes an appreciable time, the curved shape of the canopy is retained even though there is a momentary loss of wind.

2. As previously mentioned, the angle of attack of the surface of the hood is always greater than that of the canopy, in flight. That is, the hood is always closer to the vertical than the canopy. Thus if the kite is driven by an upwardly flowing wind, and the vertical component should stop, then, even though the canopy would tend to collapse the hood, having a greater angle of attack will still maintain the curvature of the hood, and therefore of the canopy.

While I have described my invention in terms of the sled type kite, it can be applied to any type of flexible, soft edge kite.

My invention has the following advantages, among others:

1. Risk of collapse is virtually eliminated. This results from
   (a) Beam effect of hood with airspace.
   (b) Increased pressure and therefore tension along the leading edge of the kite.
   (c) Increased proportion of airstream flowing over the lee surface immediately aft of the leading edge, accompanied by enhanced "Bernoulli effect" and enchanced lift.
   (d) Center of pressure of canopy is moved forward, improving aerodynamic balance as well as providing a wider range of suitable bridle positions.

2. The increased stability rendered to soft leading edges permits the use of shallower attitudes giving higher lift/drag ratios.

The Bernoulli effect cited, causes suitable tension and distension of the lee surface just aft of the leading edge, even though the hood ostensibly shields a forward portion of the canopy from direct impact of the wind.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A kite of the soft sled type comprising:

(a) a central canopy of thin flexible sheet material of a generally rectangular shape, the longitudinal side being longer than the width, and having front and rear surfaces, leading and trailing edges;

(b) two slender longitudinal battens, one attached to each side of the central canopy;

(c) a generally trapezoidal flap or hood having a longer base edge thereof secured to and along the leading edge of the canopy, said hood extending downwardly and rearwardly over a portion of the front surface of the canopy, the ends thereof being attached to the sides of the canopy, the shorter edge opposite the base edge being shorter than the width of the canopy and free of attachment thereto so as to define, in flight, an airspace between said central canopy and said trapezoidal hood which resists collapse of said leading edge; and (d) cord bridle means secured to the sides of the said canopy.

2. The kite as in claim 1 in which the width of said central canopy is in the range of 0.7 to 0.8 of the length of said central canopy.

3. The kite as in claim 1 including a halter tension means, shorter than the width of said canopy at its trailing edge, and tied between the trailing ends of said two battens.

4. The kite as in claim 3 in which the length of said halter means is in the range of 60–80% of the width of said canopy.

5. The kite as in claim 1 in which the width of the trailing edge of said canopy is less than the width of said leading edge.

6. The kite as in claim 5 in which the ratio of the width of said trailing edge to that of said leading edge of said central canopy is in the range of 0.6 to 0.8.

7. The kite as set forth in claim 1 wherein the bridle means comprises two similar side panels of triangular shape having similar edges attached to each side of said central canopy, and an elongated cord bridle having the ends thereof attached to the tips of said triangular side panels.

8. The kite as in claim 7 in which the tips of said side panels are positioned in the range of 20% to 30% of the length of said canopy back from said leading edge.

9. The kite as in claim 1 in which said hood extends back from said leading edge a distance which is in the range of 0.15 to 0.25 of the length of said central canopy.

* * * * *